United States Patent [19]

Rojas

[11] Patent Number: 5,031,835

[45] Date of Patent: Jul. 16, 1991

[54] SPRINKLER ARM

[75] Inventor: Marco Rojas, San Dimas, Calif.

[73] Assignee: Western Brass Works, Los Angeles, Calif.

[21] Appl. No.: 434,360

[22] Filed: Nov. 13, 1989

[51] Int. Cl.[5] ..... B05B 3/04

[52] U.S. Cl. ..... 239/230; 239/233; 239/511; 239/522

[58] Field of Search ..... 239/230, 232, 498, 502, 239/503, 509–512, 520, 522, 524, DIG. 1, 233

[56] References Cited

U.S. PATENT DOCUMENTS

| | | | |
|---|---|---|---|
| 533,367 | 1/1895 | McBoyle | 239/510 |
| 3,014,668 | 12/1961 | Boyd | 239/522 |
| 3,930,617 | 1/1976 | Dunmire | 239/230 |
| 4,580,724 | 4/1986 | Brown et al. | 239/230 |

*Primary Examiner*—Andres Kashnikow
*Assistant Examiner*—Karen B. Merritt
*Attorney, Agent, or Firm*—Lyon & Lyon

[57] ABSTRACT

Disclosed is an improved sprinkler arm rotatable in and out of a stream of water. In particular, the reaction surface of a sprinkler arm's spoon is improved to direct more water close to the sprinkler. The reaction surface in the preferred embodiment is provided at least one groove which directs some of the water downward from the rest of the water exiting the reaction surface. An alternate embodiment employs at least one pin in the reaction surface instead of or in combination with at least one groove. The improved spoon applies more water near the sprinkler ("enclosed water") without interfering with maximum distance of the water when the arm is rotated out of the stream ("canon shot").

3 Claims, 3 Drawing Sheets

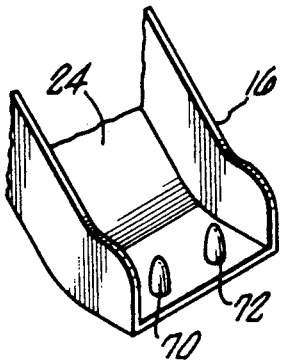
FIG. 6
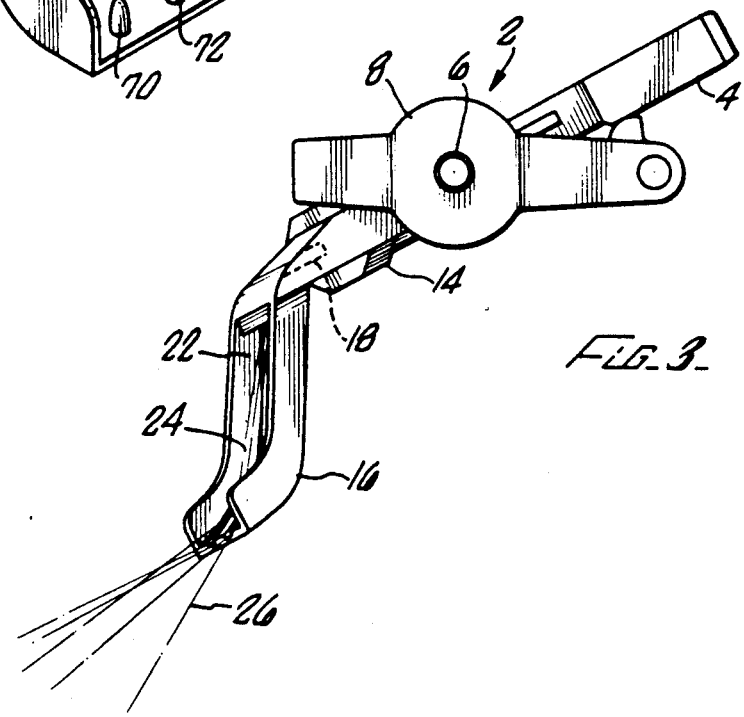
FIG. 3
FIG. 4
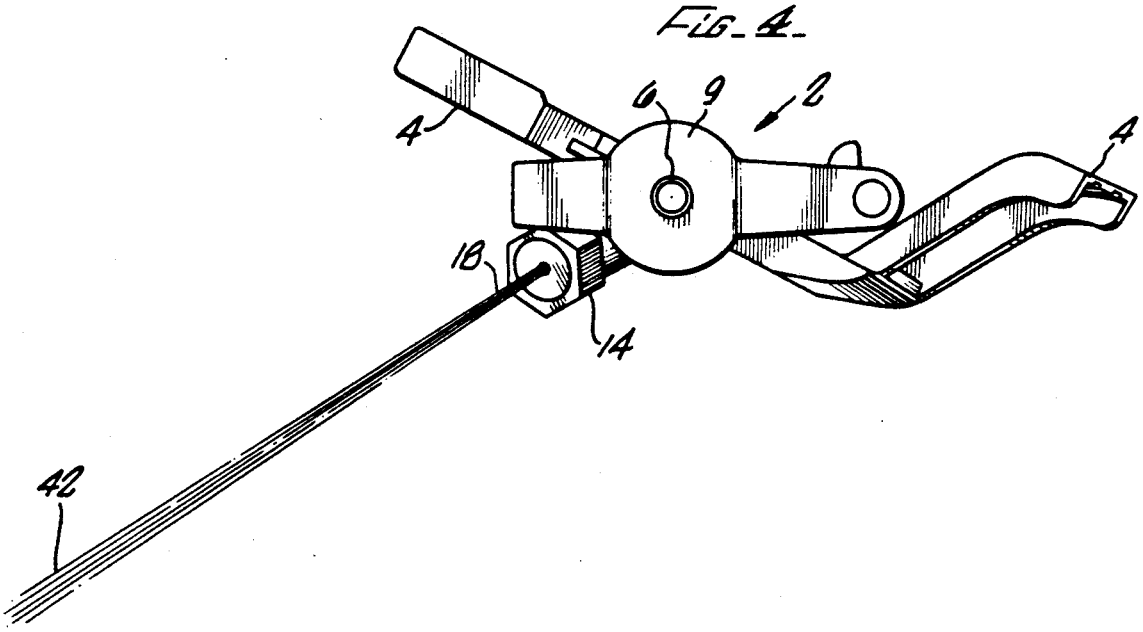

SPRINKLER ARM

BACKGROUND OF THE INVENTION

The field of the present invention relates to sprinklers. More particularly, it relates to the type of sprinkler which has an arm which is rotated into and out of a stream of water.

In the past, rotatable impact sprinklers have been manufactured with elongated members functioning as rotatable arms. A rotatable arm has been equipped with a spoon for channeling water. Incoming water from the nozzle hits an incoming ramp at the incoming end of the spoon. The water goes through a window to hit a reaction surface on the other side of the spoon toward the exit end of the spoon. Such an arm has been attached to a sprinkler body, or housing, on a fulcrum pin with a spring which pushes such arm into an incoming stream coming from a sprinkler nozzle. The force of the stream on the spoon pushes the arm back out of the stream, and the spring repeatedly pushes it back into the stream. In this way, the prior art has attempted to spread the water entering a sprinkler over a circular or pie shaped range.

However, it has been a difficult problem in the sprinkler industry to provide sufficient water near the sprinkler ("enclosed water"). Such sprinklers have distributed an undesirable high portion of incoming water to outer bands of its far ranges. A sprinkler of any prior design has left a "brown spot" in the area less than ten feet from the sprinkler due to lack of enclosed water. The problem of brown spots receiving too little enclosed water is exacerbated by the usual practice of overlapping neighboring sprinklers by about one-third their maximum radius. Overlap is needed to fill in gaps between circular sprinkler distribution patterns, but it nearly doubles the already too-high proportion of water in the outer third of each sprinkler distribution.

Various approaches have been attempted in the past to provide more enclosed water with such a sprinkler while attempting to maintain a wide range with maximal outer distance of water thrown. All of these approaches have interfered with the maximum distance which water is thrown by a "cannon shot" of a stream when the arm is not interrupting the stream.

A first prior approach has been to permanently extend a pin from the sprinkler body. Such a pin can be screwed through an extender further into or out of the stream. Since such a pin, once adjusted, is always in the stream, it interferes with maximum cannon shot projection. It also requires adjustment of each sprinkler.

A second prior approach has been to replace the pin of the first approach with a shield. Such a shield can be rotated in an out of the stream. Like the pin of the first approach, a shield is always in the same place once adjusted, and therefore interferes with maximum cannon shot projection. It too has to be adjusted for each sprinkler. A third approach has been the "controlled droplet size" (CDS) approach. CDS has been accomplished with a trapezoidal-shaped nozzle which changes the stream to a more general spray. There are many problems with CDS. CDS cuts down on the range because it causes interfering forces within an exiting spray. CDS nozzles cause more spilling outside of the spoon because the spray is wider and some water misses the spoon. Such spilling causes puddling at the base of the sprinkler. A CDS spray applies less force to the spoon because it is wider and spills more. With less force on the spoon, the arm is more likely to "hang up" by oscillating back and forth (usually less than one-eighth of an inch) in the incoming spray when there is insufficient force to push the spoon back out of the spray to permit a cannon shot.

A fourth approach has been to install a second nozzle in the sprinkler. Such a second nozzle however, requires more pressure to adequately drive an arm in and out of the first nozzle's stream. Diversion of water to a second nozzle can also cut down on the maximum cannon shot projection of the sprinkler. Most homes lack the pressure required to make such a sprinkler work properly. Most homes have 25 p.s.i. or less water pressure, whereas a second nozzle generally demands more than this.

A fifth approach has been to cut groove into the nozzle. This suffers from most of the problems of the CDS system discussed above.

SUMMARY OF THE INVENTION

The present invention provides an improved sprinkler arm rotatable in and out of a stream of water. In a preferred embodiment the reaction surface of a sprinkler arm's spoon is improved to direct more water close to the sprinkler. The, reaction surface in the preferred embodiment is provided with at least one groove which directs some of the water downward from the rest of the water exiting the reaction surface. An alternate embodiment employs at least one pin in the reaction surface instead of or in combination with at least one groove. The improved spoon of the present invention applies more water near the sprinkler ("enclosed water") without interfering with maximum distance of the water when the arm is rotated out of the stream ("canon shot" distance).

BRIEF DESCRIPTION OF THE DRAWINGS

FIG. 3 shows a top view of the sprinkler shown in FIG. 1 and FIG. 2.

FIG. 4 shows a top view of the sprinkler of FIG. 3 in cannon shot position

FIG. 6 is a drawing of an alternate design for the spoon of FIG. 2.

DETAILED DESCRIPTION OF THE PREFERRED EMBODIMENT

Figure 1:
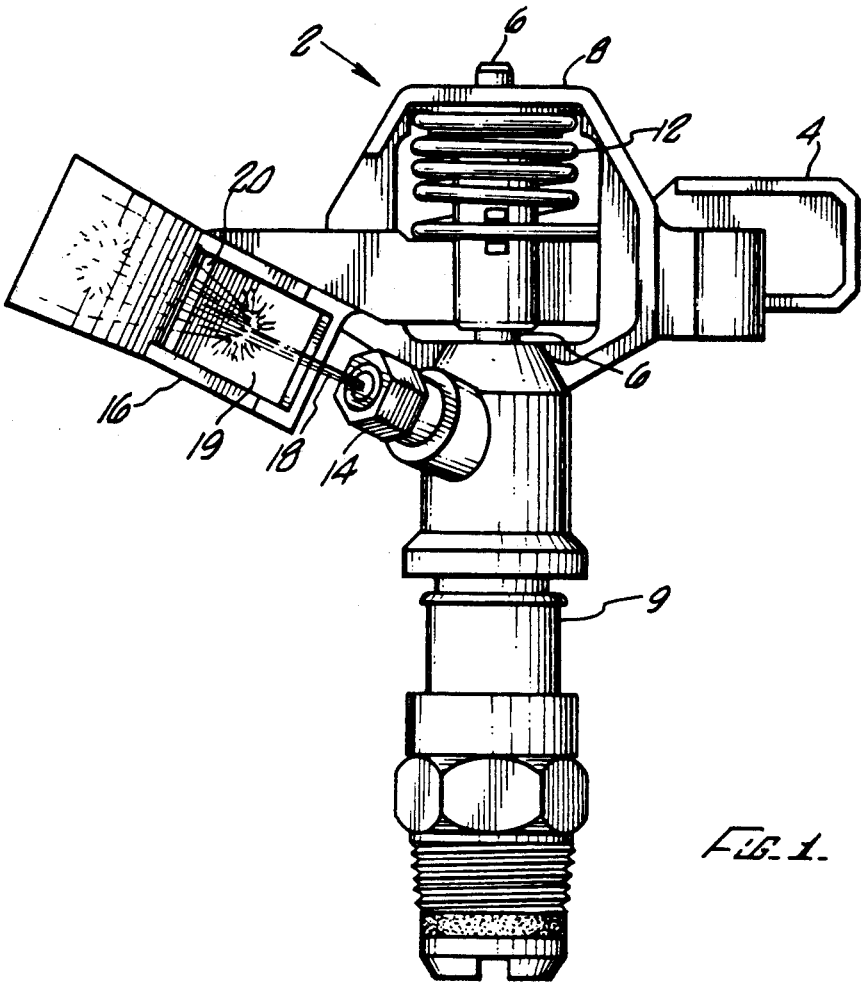
FIG. 1 is a rear view of the sprinkler in the present invention.

FIG. 1 is a rear view of the sprinkler in the present invention. Sprinkler 2 has arm 4 and which is rotatably suspended on fulcrum pin 6 of sprinkler body 8. Body 8 is rotatably connected to a water pipe (not shown) with bearing housing 9. Arm 4 is held against body 8 by arm spring 12. The end of arm 4 which is near nozzle 14 is provided with a spoon 16. Incoming stream 18 hits ramp 19 of spoon 16 and is directed through window 20 as intermediate stream 22. Intermediate stream 22 usually is taller from top to bottom in and thinner from into the page to out of the page in FIGS. 1 and 2, than is incoming stream 18. Incoming stream 18 is generally round or sometimes square, depending on nozzle 14.

Figure 2:
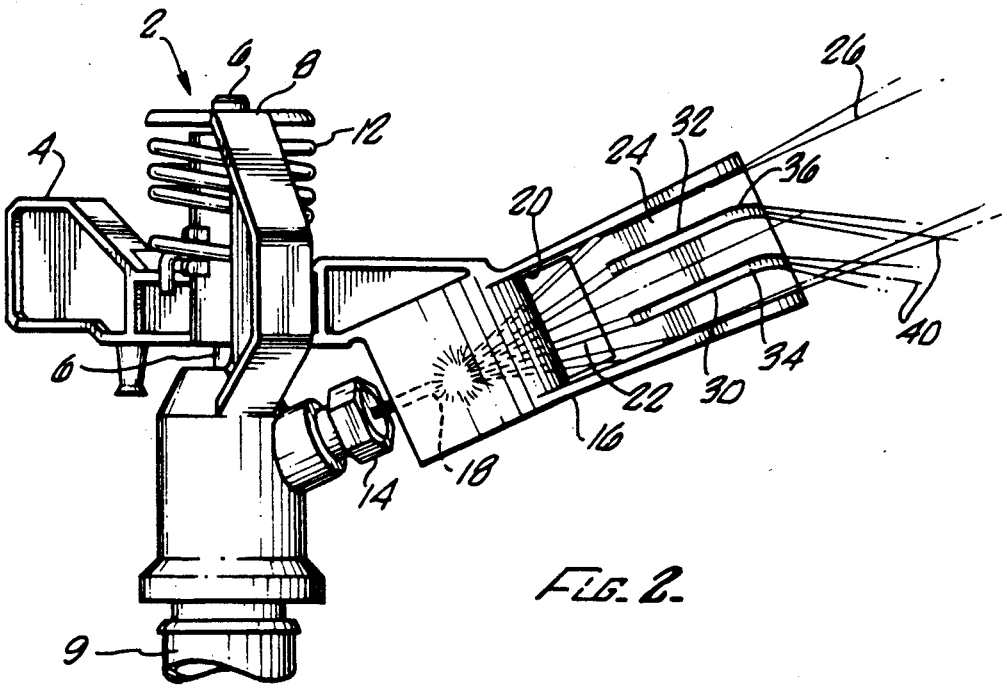
FIG. 2 is a front view of the sprinkler of FIG. 1.

FIG. 2 is a front view of the sprinkler of FIG. 1. Intermediate stream 22 comes through window 20 of spoon 16. Intermediate stream 22 then hits reaction surface 24 of spoon 16. Reaction surface 24 passes most of intermediate stream 22 in substantially the same direction to become medium distance spray 26. Medium distance spray 26, intermediate stream 22, incoming stream 18, and nozzle 14 are all disposed at an angle within the range of 15° to 25° above horizontal, or a 105° to 115° above bearing housing 9. Horizontal is defined as perpendicular to the water pipe axis. The lower end of the scale, for example 15°, is chosen for agricultural uses where there is no wind protection. The upper end of the range, for example 25°, is usually chosen where there is wind protection. If water is directed too high in unshielded wind, the wind will cut down on the maximum distance, disperse the shower away from the desired pattern, and increase evaporation of the water. The range of medium distance spray 26 depends on the pressure of water in incoming stream 18. For example, at 25 pounds of pressure per square inch (p.s.i.) for incoming stream 18, medium distance spray 26 may shower a radius from housing 8 of about (10–30 feet). Prior art sprinkler arms have provided only medium distance spray 26, with very little enclosed water, leaving a brown spot near sprinkler 2.

In the present invention, some of intermediate stream 2 is directed more downwardly than medium distance spray 26. Groove 30 and groove 32 are formed in reaction surface 24. Groove 30 and groove 32 are shallow gulleys which are substantially parallel to spoon 16 for most of the length of reaction surface 24. Near the outer end of reaction surface 24, groove 30 makes bend 34, downward of reaction surface 24 at an angle between 10° and 20°. Groove 32 makes bend 36 near the outer end of reaction surface 24, also at between 10° and 20° below the angle of spoon 16. In the preferred embodiment, bend 34 and bend 36 each make a 15° angle downward from spoon 16, from the direction of the first parallel portion, and, more importantly, from medium distance spray 26.

Preferably groove 32 and groove 30 do not quite reach window 20. If groove 32 and 30 begin at window 20, they leave notches in the shape of window 20. Such notches would split some of intermediate stream 22 away from reaction surface 24 and spray it in an uncontrolled manner to the rear of spoon 16.

Some of intermediate stream 22 is directed more downwardly than medium distance spray 26 by groove 30 and groove 32 after bend 34 and bend 36, as enclosed water 40. In the preferred embodiment, about 25% of intermediate stream 22 is directed by groove 30 and 32 as enclosed water 40, passing about 75% of intermediate stream 22 as medium distance spray 26.

FIG. 3 shows a top view of the sprinkler shown in FIG. 1 and FIG. 2. When reaction surface 24 receives enough water pressure from intermediate stream 22 (at least 15 p.s.i., for example), the force of intermediate stream 22 hitting reaction surface 24 drives arm 4 to turn in a counter clockwise direction in FIG. 3. When arm 4 turns in a counter clockwise direction, incoming stream 18 is unobstructed by spoon 16. Incoming stream 18 leaves nozzle 14 as a "cannon shot" and is unobstructed by any part of the sprinkler 2. During this cannon shot phase, sprinkler 2 has its longest range. For example, at 25 p.s.i., the range of incoming stream 18 during the cannon shot phase is 37 feet for one model of sprinkler 2, depending on wind.

FIG. 4 shows the sprinkler of FIG. 3 in cannon shot position. Shown in FIG. 4, incoming stream 18 from nozzle 14 becomes cannon shot 42 uninterrupted by arm 4. As soon as arm 4 is displaced from incoming stream 18, arm spring 12 exerts a restoring force on arm 4 such that arm 4 is pushed back into incoming stream 18. During proper operation, arm 4 is driven back and forth between the position shown in FIG. 3 and that in FIG. 4.

Figure 5:
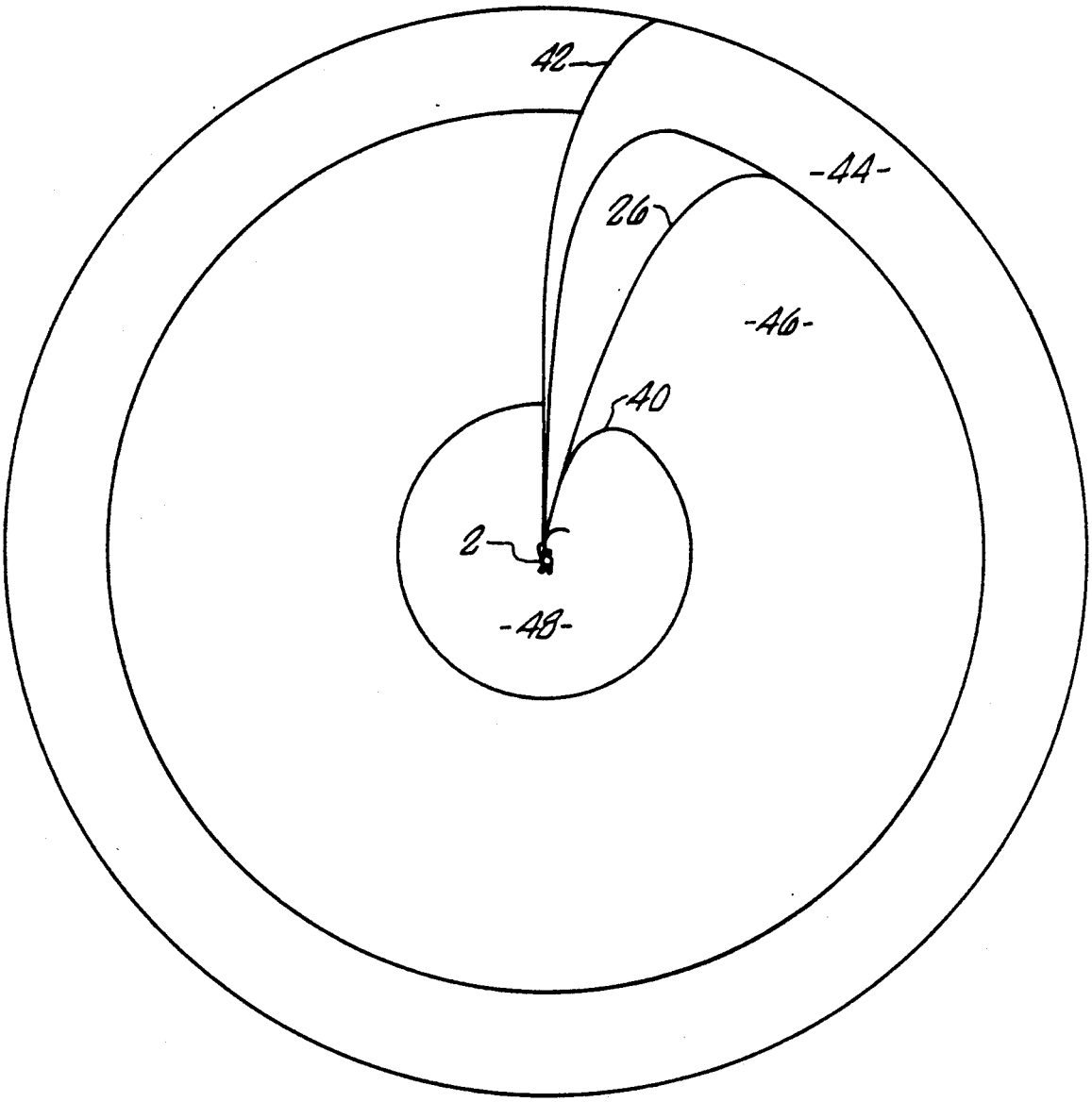
FIG. 5 is a diagram of water distribution from the sprinkler shown in FIG. 1, FIG. 2, FIG. 3, and FIG. 4.

FIG. 5 is a diagram of water distribution from sprinkler 2. Cannon shot 42 primarily covers outer cannon shot range 44. Cannon shot 42 has the same range in sprinkler 2 as in some prior art cannon shots. For example, if at 25 p.s.i. cannon shot 42 can shoot at the maximum to the outside of cannon shot range 44 at thirty-seven feet, about 67% of cannon shot 42 will land between thirty feet and thirty-seven feet from sprinkler 2. Medium spray 26 covers medium distance range 46. In this example, medium distance range 46 is from ten feet to thirty feet from sprinkler 2. Virtually all of medium spray 26 lands in medium distance range 46 depending on wind conditions. About 33% of cannon shot 42 also lands in medium distance range 46 depending on wind. In the prior art, cannon shot range 44 and medium distance range 46 were the only bands substantially watered by prior art sprinklers. Due to groove 30 and groove 32, however, the sprinkler 2 of the present invention drops up to roughly 25% or more of intermediate stream 22 as enclosed water 40. The range of enclosed water 40 is enclosed water range 48. In the example above, enclosed water range 48 is from zero feet to ten feet from the sprinkler 2. For example, if arm 4 is in incoming stream 18 as shown in FIG. 1, FIG. 2, and FIG. 3, half the time and in cannon shot position as shown in FIG. 4 the other half of the time, then cannon shot range 44 will receive 33⅓% (67% times one-half) of water leaving nozzle 14. Medium distance range 46 will receive about 54% (33% times one-half plus 75% times one-half) of water entering sprinkler 2. Enclosed water cannon shot range 44 will receive roughly 12½% (25% times one-half) of water leaving nozzle 14 in this example achievable with the present invention.

Reaction surface 24 shown in FIG. 2 is preferably designed as follows. Groove 30 and groove 32 are identical to each other except in placement. Groove 30 is preferably 0.030–0.040 inches deep into reaction surface 24 and 0.070–0.080 inches wide from top of groove 30 to the bottom of groove 30 in FIG. 2. If groove 30 is made too large (too deep or too wide) then the volume of enclosed water 40 is enhanced at the expense of the volume of medium distance spray 26. If groove 30 is too small (too narrow or too shallow), then groove 30 has too little effect and less enclosed water 40 is provided for enclosed water range 48. The angle of bend 34 is preferably between 10° and 20°. A greater downward angle would push spoon 16 up and cause too much friction with fulcrum pin 6. Such friction would interfere with the ability of arm 4 to be driven back and forth between the positions shown in FIG. 3 and FIG. 4. Friction at fulcrum pin 18 can also lead to excess wear on sprinkler 2. If bend 34 has less of an angle than 10°, then less water is sprinkled near sprinkler 2. In the preferred embodiment there are two grooves 30 and 32. Use of three grooves or more is possible but less desireable because it would cut down on the distance of medium distance spray 26 and drop too little water on the outer portions of medium distance range 46. Groove 30 which is at the bottom of reaction surface 24 directs some of intermediate stream 22 at an angle of about 15° below the rest of medium distance spray 26. Groove 32 also directs some of intermediate stream 22 down at an angle of 15°. However, such directed water is partially in medium distance spray 26 as medium distance spray 26 leaves reaction surface 24. Therefore, water exiting groove 32 interferes with medium distance spray 26 and cuts down somewhat on the distance of medium distance spray 26. A third groove, which would be placed above the bottom of surface reaction 24 (because groove 30 already is placed near the bottom) would further interfere with medium distance spray 26. Use of only one groove is not as preferred as two grooves because if it were the same as groove 30, some of enclosed water 40 from groove 32 would no longer land in enclosed water range 48. To increase the size of groove 30 enough to direct 25% of intermediate stream 22 downward to become enclosed water 40 would cut down on the range of medium distance spray 26 and enclosed water 40. An increase in depth of groove 30 would require a thicker spoon 16. A thicker spoon 16 would necessitate a stronger, more expensive spring 12 and heavier, more expensive arm 4. The positioning of groove 30 and groove 32 is preferably as shown to get even spreading in enclosed water range 48. Water exiting groove 30 has a different spreading pattern than water exiting groove 32 because of differential interference by medium distance spray 26 due to having differential amounts of intersection. Agricultural irrigation water which might be used for incoming stream 18 is not always filtered well. If groove 30 were deeper or more grooves were added, unfiltered debris in incoming stream 18 might clog reaction surface 24. Reaction surface 24 is preferably more than one-half inch wide (from top to bottom in FIG. 2), which increases the amount of water which surface reaction 24 catches. This throws more water in enclosed water range 48 and medium distance range 46, and also provides more driving force to drive arm 4 into cannon shot position shown in FIG. 4.

Spoon 16 in the present invention is heavier than spoons used in prior sprinklers. For example, spoon 16 weighs 1.7 ounces, whereas prior art spoons usually weighed less than 1.5 ounces or less. There are at least three reasons for this.

One, a heavier spoon means that spring 12 will take longer to return arm 4 from cannon shot position shown in FIG. 4 to interrupting incoming stream 18 as shown in FIG. 3. This permits more time spent in the cannon shot position in the present invention than in the prior art. This gives cannon shot 42 a better chance to reach its full distance capability and increase the distance of the outer portion of cannon shot range 44 from sprinkler 2. Prior sprinkler designers thought that more frequent interruption of arm 4 into incoming stream 18 would actually increase the distance of cannon shot 42 because of a supposed vortex effect due to air rushing alongside of cannon shot 42. However, in actual use, even the slightest wind nullifies any vortex effect.

Two, a heavier spoon causes medium distance spray 26 to land closer to sprinkler 2 because surface reaction 24 interrupts incoming stream 18 for a longer period each time arm 4 is in a position shown in FIG. 3 and because more momentum is transferred from incoming stream 18 to spoon 16.

Three, a heavier spoon changes the balance moment about fulcrum pin 6. Prior sprinkler designers thought that the weight of arm 4 should be perfectly balanced around fulcrum pin 6. However, in the present invention the end of arm 4 with spoon 16 is 20% heavier than the other end of arm 4. This decreases hanging up of arm 4 in incoming stream 18. Sprinkler arms in the past have had the problem of hanging up in incoming stream 18 by oscillating back and forth while remaining in incoming stream 18 and never moving to cannon shot position. A heavier, more sluggish spoon 16 in the present invention is not so easily oscillated or "hung up" as arms with prior, lighter spoons.

FIG. 6 shows an alternate embodiment for spoon 16. Pin 70 and pin 72 ar positioned at the exit end of reaction surface 24. Pin 70 and pin 72 will split some of intermediate stream 22 for application to enclosed water range 48. This embodiment is not preferred for agricultural irrigation systems because such systems sometimes use unfiltered water. Debris in unfiltered water can possibly catch on pin 70 and pin 72 and clog spoon 16.

What is claimed is:

1. A sprinkler arm comprising:

a elongated member rotatably attachable to an impact sprinkler;

a window disposed in said member for the passage of incident liquid therethrough; and a spoon disposed at one end of said elongate member proximate said window, said spoon defining a smooth reaction surface and at least one groove in said reaction surface for directing a first portion of the incident liquid more downwardly than a second portion of the incident liquid, said groove defining a first portion spaced from said window and extending parallel to said reaction surface and a second portion extending from said first portion and being inclined downwardly with respect to said first portion.

2. The sprinkler arm of claim 1 wherein said second portion of said groove is disposed at an angle of about 15 to 25° downwardly with respect to said first portion.

3. The sprinkler arms of claims 1 or 2 including a second groove in said reaction surface, said second groove extending parallel to said first groove.

* * * * *